US007664445B2

(12) United States Patent
Nishida et al.

(10) Patent No.: US 7,664,445 B2
(45) Date of Patent: Feb. 16, 2010

(54) IMAGE FORMING APPARATUS

(75) Inventors: Satoshi Nishida, Saitama (JP); Mineyuki Sako, Toyokawa (JP); Shigetaka Kurosu, Hino (JP); Kazuteru Ishizuka, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 404 days.

(21) Appl. No.: 11/820,762

(22) Filed: Jun. 20, 2007

(65) Prior Publication Data

US 2008/0056780 A1 Mar. 6, 2008

(30) Foreign Application Priority Data

Aug. 31, 2006 (JP) ..... 2006-235332

(51) Int. Cl.
*G03G 15/16* (2006.01)
*G03G 15/00* (2006.01)

(52) U.S. Cl. ..... 399/316; 399/45

(58) Field of Classification Search ..... 399/316, 399/388, 317, 66, 45
See application file for complete search history.

(56) References Cited

U.S. PATENT DOCUMENTS 4,268,157 A * 5/1981 Ebi et al.
4,739,362 A * 4/1988 Kau et al. ..... 399/316
4,926,219 A * 5/1990 Hirasawa et al. ..... 399/316
RE33,844 E * 3/1992 Koizumi et al. ..... 399/316
5,182,534 A * 1/1993 Hara
5,953,575 A * 9/1999 Park et al. ..... 399/388
6,055,409 A * 4/2000 Richards et al. ..... 399/388
6,493,534 B2 * 12/2002 Sawanaka et al. ..... 399/316
2006/0045580 A1 * 3/2006 Matsuura ..... 399/316
2007/0280750 A1 * 12/2007 Kurosu et al. ..... 399/316

FOREIGN PATENT DOCUMENTS

JP 63-54160 4/1988
JP 05221551 A * 8/1993
JP 5-289545 11/1993
JP 06230626 A * 8/1994
JP 08185063 A * 7/1996
JP 10-123848 5/1998
JP 2000075565 A * 3/2000
JP 2001240268 A * 9/2001
JP 2003-122142 4/2003

OTHER PUBLICATIONS

Japanese Office Action for Japanese Patent Application No. 2006-235332 mailed Sep. 16, 2008 with English Translation.

* cited by examiner

*Primary Examiner*—Susan S Lee
(74) *Attorney, Agent, or Firm*—Cantor Colburn LLP

(57) ABSTRACT

An image forming apparatus having: an image forming section to form a toner image on an image carrier; a transfer section to transfer onto a transfer medium the toner image formed on the image carrier; and a pair of opposing transfer guide members to guide the transfer medium into the transfer section, wherein a front edge of one transfer guide member, arranged on a side of the image carrier out of the pair of the transfer guide members, is disposed separately from the other transfer guide member, and one side portion of the front edge of the transfer guide member is more protruded than the other side portion into a conveying direction of the transfer medium.

17 Claims, 6 Drawing Sheets

IMAGE FORMING APPARATUS

CROSS REFERENCE TO RELATED APPLICATION

The present application is based on Japanese Patent Application No. 2006-235332 filed with Japan Patent Office on Aug. 31, 2006, the entire content of which is hereby incorporated by reference.

BACKGROUND OF THE INVENTION

1. Field of the Technology

The present invention relates to an image forming apparatus based on electrophotographic technology such as a photocopier, printer and fax machine, particularly to an image forming apparatus capable of stable transfer of a toner image formed on an image carrier onto a transfer medium.

2. Description of Related Art

In the process of transferring a toner image onto the transfer medium, a spring back occurs when the trailing edge of the transfer medium passes through the transfer guide member to come into contact with the image carrier. The degree of spring back differs according to the type of the transfer medium and the conveying path before and after the transfer section. To ensure satisfactory transfer operation, a certain amount of curvature of concavo-convex structure is essential in the conveying path. Even if the guide member is placed close to the image carrier, a tough transfer medium such as a thick paper or heavy paper is very rigid, and the trailing edge of the transfer medium tends to hit the image carrier. In the example shown in FIGS. 4(*a*)-(*b*), spring back of the trailing edge occurs at 20 mm from the transfer area (FIG. 4 (*a*)) to cause an image failure wherein the toner image at the transfer area is scattered or misaligned by that impact shock (FIG. 4 (*b*)).

FIGS. 4(*a*)-(*b*) is a drawing representing the scattering of characters due to the spring back of the trailing edge of the transfer medium in the secondary transfer area of an intermediate transfer belt.

The following methods have been proposed to avoid the image failure of this type according to the conventional method: A flexible shielding plate such as a polyester film is bonded to the front edge of one guide member. When the transfer medium passes through the aforementioned guide member, the shielding plate presses the transfer medium elastically against the other guide member. When the transfer medium does not passes through it, the shielding plate comes in contact with the front edge of the other guide member, and the front edge of the aforementioned shielding plate is displaced in the conveying direction whereby spring back is prevented (e.g., Unexamined Japanese Patent Application Publication No. 10-123848). For a highly rigid transfer medium, a special mode can be selected by the special mode key, and a solenoid is turned on to perform such an operation that the front side of the transfer guide plate approaches the photoreceptor drum using the set screw on the back side as a fulcrum (e.g., Unexamined Japanese Patent Application Publication No. 5-289545). According to another proposal, only part of the transfer current value is changed.

However, when the flexible film member is bonded on the transfer guide member, the film member corresponding to the upper guide is pressed against the lower guide at all times. This method, therefore, cannot meet various types of sheets, and a problem occurs in the cased of thin paper. To be more specific, since thin paper is not sufficiently stiff, only one side of paper is bent conspicuously when a film having its one end formed to be protruded is pressed against the other guide, with the result that uneven conveyance occurs, and the front edge of paper cannot enter the nip of the transfer section. Since paper enters the nip in a bent form, the image is transferred on paper as it is tilted. Further, insufficient durability of the film can be a problem.

The method of approaching the transfer guide member to the image carrier (photoreceptor drum) will cause toner contamination.

There is a limit to the method of modifying and adjusting the transfer current value. To be more specific, although toner scattering and image misalignment can be reduced to some extent, when the current value is adjusted to the level that completely eliminates the possibility of toner scattering and image misalignment, an image failure will occur to the solid image over the entire surface or the half-tone image over the entire surface wherein there is caused a failure image of density change in that portion.

The object of the present invention is to provide an image forming apparatus capable of eliminating the possibility of an image failure caused by spring back, without using the film member, and without approaching the transfer guide member to the image carrier.

SUMMARY

The aforementioned object can be achieved by the following structures:

An image forming apparatus reflecting one aspect of includes an image forming section to form a toner image on an image carrier; a transfer section to transfer onto a transfer medium the toner image formed on the image carrier; and a pair of opposing transfer guide members to guide the transfer medium into the transfer section, wherein a front edge of one transfer guide member, arranged on a side of the image carrier out of the pair of the transfer guide members, is disposed separately from the other transfer guide member, and one side portion of the front edge of the transfer guide member is more protruded than the other side portion into a conveying direction of the transfer medium.

An image forming apparatus reflecting another aspect of the present invention includes: an image forming section to form a toner image on an image carrier; a transfer section to transfer onto a transfer medium the toner image formed on the image carrier; and a pair of opposing transfer guide members to guide the transfer medium into the transfer section, wherein an angle difference between the front edge of the transfer guide member arranged on the side of the image carrier out of a pair of the transfer guide members, and the trailing edge of the transfer medium having been fed through the front edge is changed in response to a type of the transfer medium, where the angle difference is a difference between a first angle formed by a main scanning direction and the front edge of the guide member, and a second angle formed by the main scanning direction and the trailing edge of the transfer medium.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Figure 1:
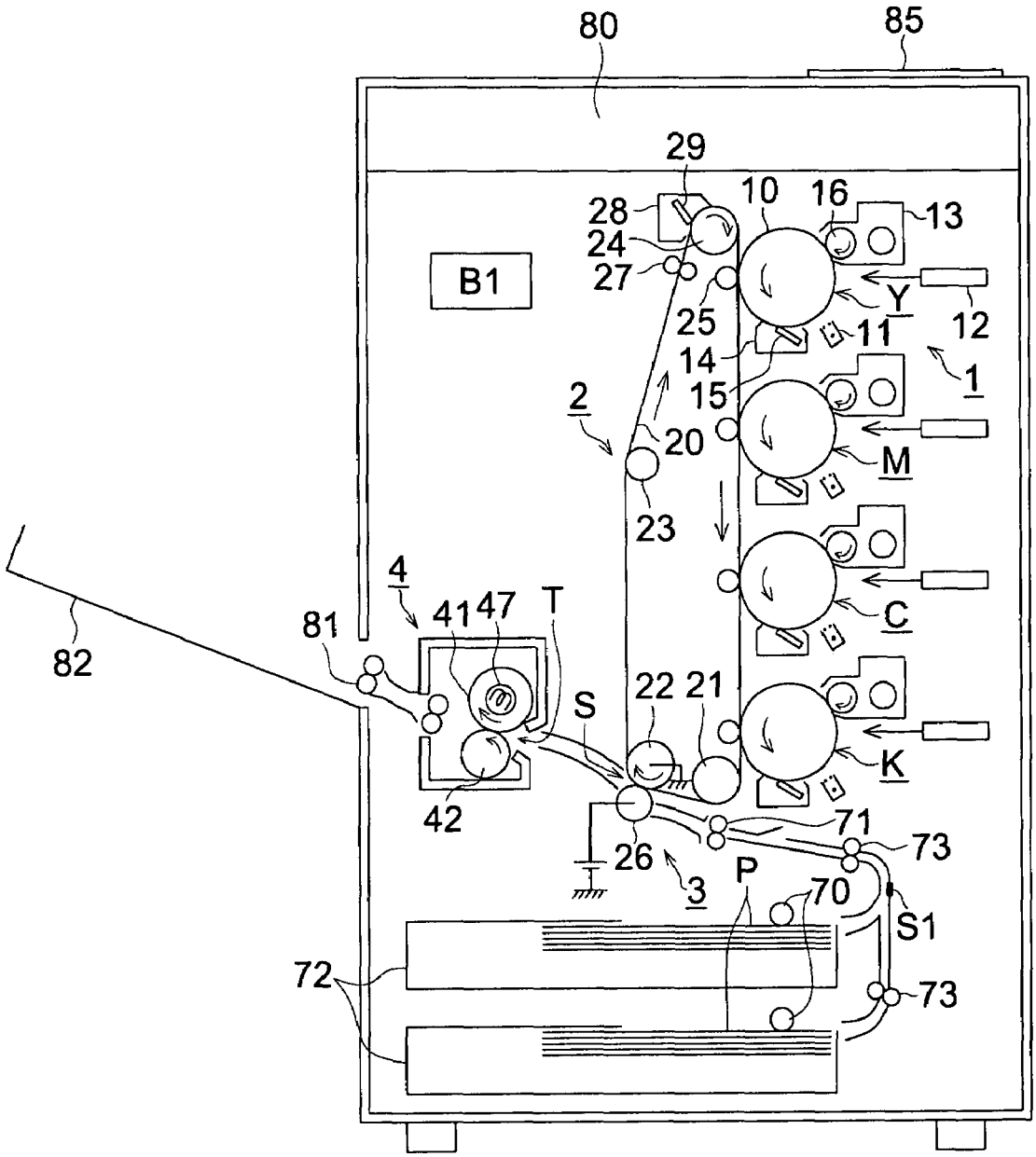
FIG. 1 is a schematic diagram representing an example of the overall structure of an image forming apparatus.

In the first place, the following describes the image forming apparatus of the present invention with reference to FIG. 1.

In the description of the embodiments of the present invention, the technical scope is not restricted by the terminologies used in this Specification.

FIG. 1 is a schematic diagram representing an example of the overall structure of an image forming apparatus.

In FIG. 1, 10 denotes a photoreceptor drum, 11 a scorotron charger as a charging section, 12 a writing unit as a digital exposure writing section, 13 a developing device as a developing section, 14 a cleaning apparatus for cleaning the surface of the photoreceptor 10, 15 a cleaning blade for scraping off the remaining toner from the photoreceptor drum 10, 16 a development sleeve, and 20 an intermediate transfer belt as an image carrier.

The image forming unit 1 as an image forming section incorporates a photoreceptor drum 10, scorotron charger 11, developing device 13, and cleaning apparatus 14. The mechanical structure of the image forming unit 1 is the same for each color. In FIG. 1, reference numerals are assigned to the structure of Y (yellow) series. The reference numerals for the components of M (magenta), C (cyan) and K (black) are omitted.

The image forming unit 1 for each color is arranged in the order of Y, M, C and K as viewed in the traveling direction of the intermediate transfer belt 20. In the primary transfer area wherein the photoreceptor drum 10 and primary transfer roller 25, the photoreceptor drum 10 rotates in the same direction as the traveling direction of the intermediate transfer belt 20 at the same linear speed.

The intermediate transfer belt 20 is applied to the drive roller 21, ground roller 22 (diameter: 30 mm; conductive solid rubber; hardness: 67±3 degrees; electrical resistivity: $4\times10^{7}\Omega$ in the present embodiment), tension roller 23, discharging roller 27 and driven roller 24. The belt unit 2 is made up of these rollers, intermediate transfer belt 20, primary transfer roller 25, and cleaning apparatus 28 as a cleaning unit. The aforementioned ground roller (backup roller) 22 is a conductive aluminum roller with background portion made of aluminum, and is connected to the ground.

The photoreceptor drum 10 is made up of a photosensitive layer such as a conducting layer, a-Si layer or organic photoreceptor (OPC) formed on the outer periphery of a cylindrical metallic substrate made of an aluminum material, for example. It rotates in the counterclockwise direction indicated by an arrow in FIG. 1, with the conducting layer connected to the ground.

The electric signal corresponding to the image data from the reading apparatus 80 is converted into an optical signal by an image forming laser and is projected onto the photoreceptor drum 10 by the writing unit 12 in such a manner that the photoreceptor drum 10 is scanned by a laser beam in the main scanning direction, which is approximately vertical to the moving direction of the photoreceptor drum surface.

The developing device 13 maintains a predetermined distance from the peripheral surface of the photoreceptor drum 10, and has a development sleeve 16 made of a cylindrical non-magnetic stainless steel or aluminum material that rotates in the direction opposite to that of the photoreceptor drum 10.

The intermediate transfer belt 20 is driven by the rotation of the drive roller 21 by a drive motor (not illustrated). In this embodiment, the traveling speed is 220 mm/s. Material of this intermediate transfer belt 20 is an endless belt made of a material having a volume resistivity of $10^{6}$ through $10^{12}$ Ω·cm. It is a two-layer seamless belt which is manufactured by applying a fluorine coating having a thickness of 5 through 50 μm, preferably as a toner filming preventive layer, to the outside of a semiconductor film having a thickness of 0.04 through 0.10 mm produced by dispersing a conductive material into an engineering plastic such as denatured polyimide, thermosetting polyimide, ethylene tetrafluoroethylene copolymer, vinylydene polyfluoride and nylon alloy.

The DC voltage of polarity reverse to that of toner is applied to the primary transfer roller 25, and intermediate transfer belt 20 is pressed against the photoreceptor drum 10 from inside the belt by a pressure contact mechanism and pressure contact releasing mechanism (not illustrated) so that the toner image is transferred onto the intermediate transfer belt 20.

The reference numeral 26 is a secondary transfer roller (made of the same material as the ground roller 22 in the present embodiment) as a transfer section and is pressed against the ground roller 22 by a pressure contact mechanism and pressure contact releasing mechanism (not illustrated) through the transfer medium P. It has a function of transferring the toner image on the intermediate transfer belt 20 onto the transfer medium P using the nip portion S as the transfer area. It should be noted that bias voltage of the polarity reverse to that of the toner is applied to the secondary transfer roller 26 (or voltage of the same polarity as that of the toner can be applied to the ground roller 22 and the secondary transfer roller 26 can be connected to the ground) at the time of transfer.

The AC voltage superimposed by the DC voltages having the same or reverse polarity to that of toner is applied to the discharging roller 27. After the toner image has been transferred onto the transfer medium P, electric charge of the toner remaining on the intermediate transfer belt 20 is reduced.

The reference numeral 3 is a transfer guide member of the present invention, and is made up of a pair of opposing plates—an upper transfer guide plate 31 arranged on the side of the intermediate transfer belt 20 as an image carrier and a lower transfer guide plate 32. Details of the upper transfer guide plate 31 will be described later.

The reference numeral 4 is a fixing apparatus as a fixing section, and incorporates a heating roller 41 and a pressure contact roller 42.

The aforementioned heating roller 41 has a cylindrical form made of a thin aluminum, and is equipped with a halogen heater 47 for heating up to a predetermined temperature level from inside. The temperature is detected by the contact type temperature sensor (not illustrated) installed on the aforementioned heating roller 41, and is controlled by the control section B1.

The reference numeral 70 is a sheet feed roller, 71 a registration roller, 72 a sheet cassette, and 73 a conveying roller. The reference numeral 81 is an ejection roller to eject the fixed transfer medium to the ejection tray 82.

The reference numeral S1 is a sheet type detecting sensor for detecting the sheet type (thickness or weight) of the transfer medium to be transferred, and is arranged on the sheet cassette 72 or the sheet conveyance path. According to the signal having been detected, the control section B1 issues the command for operating the transfer medium rotating mechanism and transfer guide member to be discussed later.

The control section B1 controls the image forming process, fixing temperature, transfer medium conveyance, toner density and registration roller pressure force.

The following describes the image forming process with reference to FIG. 1.

When the photoreceptor drive motor (not illustrated) has started simultaneously with the start of the image recording, the photoreceptor 10 of color signal Y rotates in the counterclockwise direction shown by an arrow mark. At the same time, electrical potential is given to the photoreceptor 10 by the charging function of the scorotron charger 11.

After the electrical potential has been given to the photoreceptor 10, writing of the image corresponding to the Y-color image data is started, and the electrostatic latent image corresponding to the Y-color image of the document image is formed on the surface of the photoreceptor 10 by the writing unit 12.

The aforementioned electrostatic latent image is subjected to reversal development in the non-contact mode by the Y-color developing device 13, and the Y-color toner image is formed on the photoreceptor 10 in response to the rotation of the photoreceptor 10.

The Y-color toner image formed on the photoreceptor 10 is subjected to primary transfer onto the intermediate transfer belt 20 (an image carrier) by the function of the Y-color primary transfer roller 25.

After that, the remaining toner is removed from the aforementioned photoreceptor 10 by the cleaning blade 15, and the system enters the next image forming cycle (the same applies to the cleaning processes for M, C and K colors, which will not be described to avoid duplication).

After that, the image corresponding to the M (magenta) color signal, namely, the M-color image data is written by the writing unit 12, and an electrostatic latent image corresponding to the M-color image of the document image is formed on the surface of the photoreceptor 10. This electrostatic latent image is formed into an M-color toner image on the photoreceptor 10 by the M-color developing device 13. In the M-color primary transfer roller 25, this image is synchronized with the aforementioned Y-color toner image on the intermediate transfer belt 20 and is superimposed on the aforementioned Y-color toner image.

This image is synchronized with the Y- and M-color superimposed toner image by the similar process and the C-color (cyan) toner image is superimposed on the aforementioned Y- and M-color superimposed toner image by the C-color primary transfer roller 25. Then it is synchronized with the Y-, M- and C-color superimposed toner image having been formed already, and the K-color toner image K-color primary transfer roller 25 is superimposed on the aforementioned Y-, M- and C-color superimposed toner image, whereby a Y-, M-, C- and K-color superimposed toner image is formed.

The intermediate transfer belt 20 carrying the superimposed toner image is fed in the clockwise direction as shown by the arrow. The transfer medium P is fed out by the sheet feed roller 70 by the sheet cassette 72, and is then is conveyed to the registration roller 71 through the conveying roller 73. It is stopped temporarily, and is then driven by the aforementioned registration roller 71 to be synchronized with the superimposed toner image on the intermediate transfer belt 20. The transfer medium P goes through the guide member 3 (to be described later) and is fed to the nip section S of the secondary transfer roller 26 (pressed against the intermediate transfer belt 20) to which the DC voltage of polarity reverse to that of toner is applied. Then the superimposed toner image on the intermediate transfer belt 20 is collectively transferred onto the transfer medium P secondarily.

After that, the intermediate transfer belt 20 travels, and electric charge of the remaining toner is reduced by the discharging roller 27. The toner remaining on the belt is removed by the blade 29 of the cleaning apparatus 28. Then the system goes to the next image forming cycle.

The toner having been scraped off is collected in the cleaning apparatus 28, and is conveyed in the axial direction (from sheet surface to sheet rear in the drawing) by the rotation of a conveying screw (not illustrated). Then it is collected into a reservoir box through a waste pipe (not illustrated).

The transfer medium P with the aforementioned superimposed toner image having been transferred thereon is conveyed to the fixing apparatus 4, and is sandwiched between the nip portions T of the heating roller 41 and pressure roller 42, whereby pressure is applied and the toner image is fixed. The transfer medium P with the toner image fixed thereon is conveyed to the ejection tray 82 by a sheet ejection roller 81.

The following describes the transfer guide member 3 of the present invention.

As described above, a tough transfer medium (hereinafter also called "sheet") such as a thick paper or heavy paper is very rigid, and the trailing edge of the transfer medium tends to hit the image carrier when it goes out of the transfer guide member 3. The toner image at the transfer area is scattered or misaligned by that impact shock due to the impact shock at the time of spring back, whereby an image failure occurs.

The aforementioned image failure can be avoided by applying the following measures to the transfer guide member that guides the transport member to the transfer section.

Figure 2:
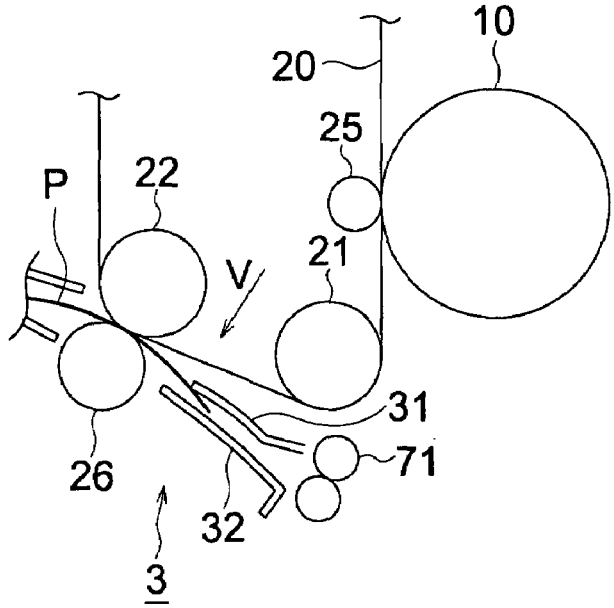
FIG. 2 is a cross sectional view representing an enlarged view of the portion close to the secondary transfer roller and transfer guide member of FIG. 1.

FIG. 2 is a cross sectional view representing an enlarged view of the portion close to the secondary transfer roller and transfer guide member of FIG. 1.

Figure 3:
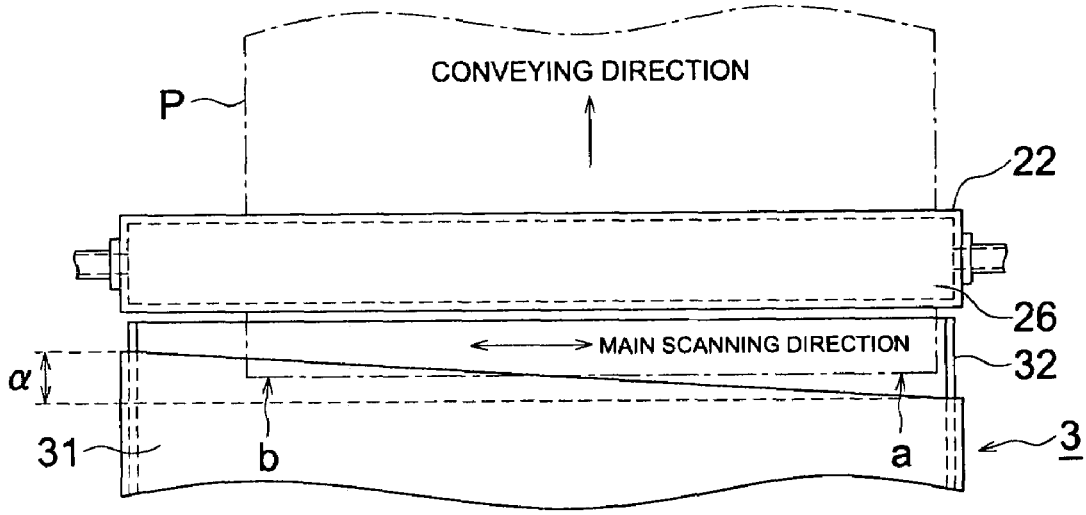
FIG. 3 is a plan view of the portion close to the secondary transfer roller and transfer guide member of FIG. 2 as observed from the V-marked direction.
Figure 4:
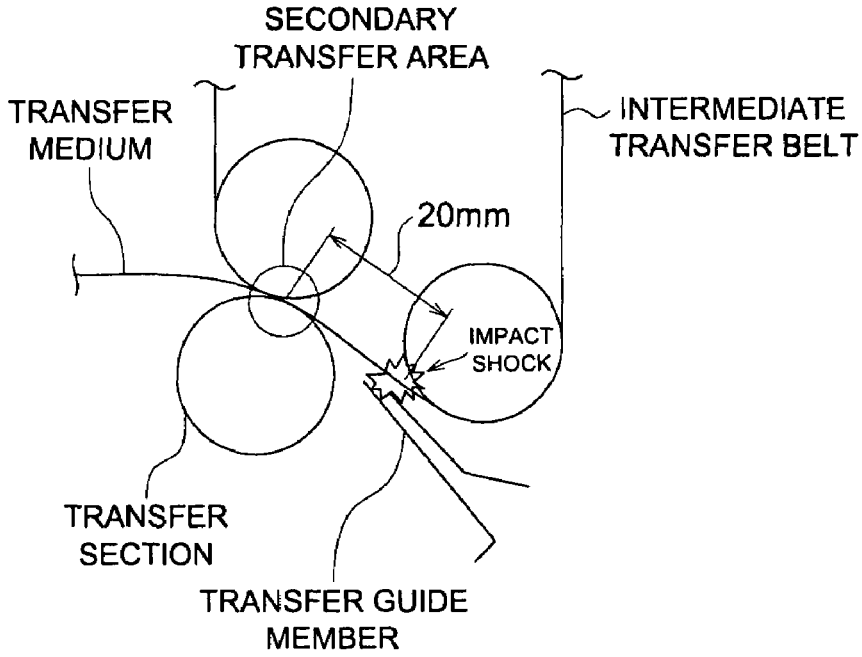
FIGS. 4 (*a*) and (*b*) are diagrams showing scattering of characters due to spring back of the trailing edge of the transfer medium in the secondary transfer area of an intermediate transfer belt.
Figure 4:
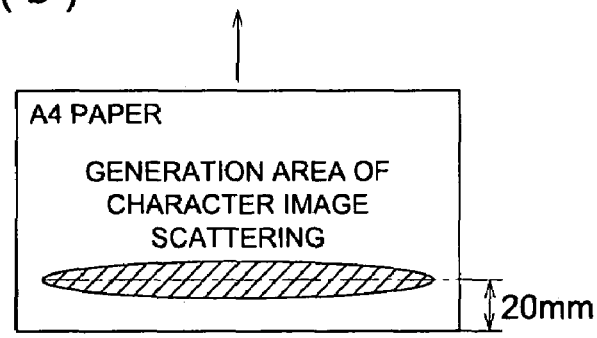

FIG. 3 is a plan view of the portion close to the secondary transfer roller and transfer guide member of FIG. 2 as observed from the V-marked direction.

In FIG. 2 and FIG. 3, to ensure satisfactory transfer operation, the conveying path in the vicinity of the secondary transfer roller as a transfer section is bent with respect to the transfer medium conveying direction. The upper transfer guide plate 31 as a transfer guide member arranged on the side of the image carrier is formed in such a way that one side of the front edge protrudes $\alpha$ (4 mm in this embodiment) from the other side. The amount of protrusion is gradually reduced from one end to the other in the main scanning direction. The upper transfer guide plate 31 is arranged separate from the lower transfer guide plate 32 without contacting each other.

The transfer medium P is guided by the upper transfer guide plate 31 and lower transfer guide plate 32, and is sandwiched between the nip portions S of the secondary transfer roller 26, whereby toner image on the intermediate transfer belt 20 is transferred. The stiff transfer medium P such as thick paper travels in contact with the upper transfer guide plate 31, and comes in contact with the aforementioned intermediate transfer belt 20. At this time, the front edge portion of the aforementioned transfer guide plate 31 projects α, and therefore, the trailing edge of the aforementioned transfer medium is led from one side "a" to the other side "b" so as to come in contact with the intermediate transfer belt 20. To be more specific, the opposing guide plate is opened at all times, without one side of the less stiff thin paper being pressed. This arrangement avoids misalignment in the conveyance of thin paper. Further, in the case of thick paper, the sheet trailing edge comes in contact with the image carrier only gradually without all the trailing edges being subjected to spring back in one time. This arrangement reduces impact shock and avoids an image failure at the nip portion S as a transfer area.

The upper transfer guide plate of the aforementioned embodiment and upper transfer guide plate without protrusion (Comparative Example) were mounted on an apparatus under the aforementioned conditions to conduct a comparative test.

Test Condition

Model used: Tandem type color photocopier

Intermediate transfer belt: Thermosetting polyimide coated with conductive material; thickness: 0.10 mm; belt speed: 220 mm/s Secondary transfer roller: Diameter 30 mm, conductive solid rubber, hardness: 67±3 degrees; electrical resistivity: $4\times10^7\Omega$ Ground roller: Diameter 30 mm, conductive solid rubber, hardness 67±3 degrees, electrical resistivity: $4\times10^7\Omega$ Protrusion α: 4 mm for the Example, and 0 mm for the Comparative Example (the front edge of the lower transfer guide plate is always kept parallel to the sheet trailing edge)

Paper used: A4, 256 g/m$^2$ (thick paper)

Test Evaluation

The level of scattering of image characters at the time of paper feed was evaluated.

Result

There was no scattering of image characters in Example, but image characters were scattered in the Comparative Example.

The aforementioned test has verified that scattering of image characters could be avoided by leading it from one side of the trailing edge of the transfer medium in the main scanning direction so as to contact the aforementioned image carrier, using a upper guide plate whose one side is projected over the other with respect to the main scanning direction in the transfer medium conveying path. In this Example, it has been verified that there was no problem when thin paper (80 g/m$^2$) was fed.

The following describes the mechanism wherein the aforementioned transfer medium is fed in response to the type of the transfer material while the front edge of the guide member arranged on the side of the image carrier and the trailing edge of the transfer medium keep a predetermined angle difference (the angle difference is an angle formed between the front edge of the guide member and the trailing edge of the transfer medium), whereby the impact shock on the image carrier of the transfer medium trailing edge was reduced. Said angle difference can be obtained as a difference between the first angle, formed by the main scanning direction and the front edge of the guide member, and the second angle formed by the main scanning direction and the trailing edge of the transfer medium.

Figure 5:
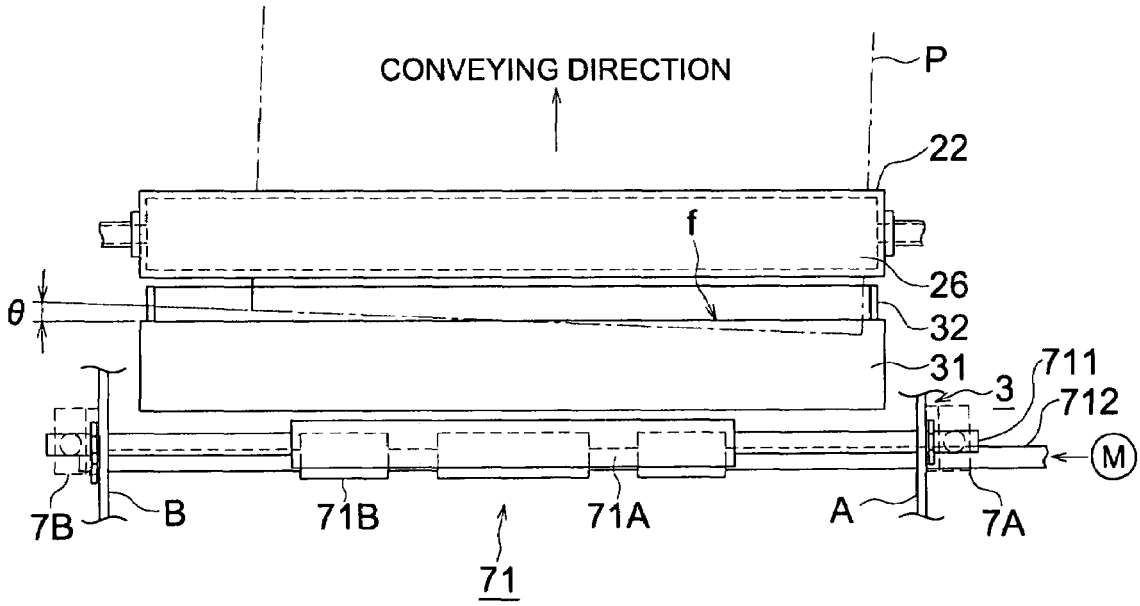
FIG. 5 is a plan view of the position close to the secondary transfer roller, transfer guide member and registration roller of FIG. 2 as observed from the V-marked direction.

FIG. 5 is a plan view of the position close to the secondary transfer roller, transfer guide member and registration roller of FIG. 2 as observed from the V-marked direction.

Figure 6:
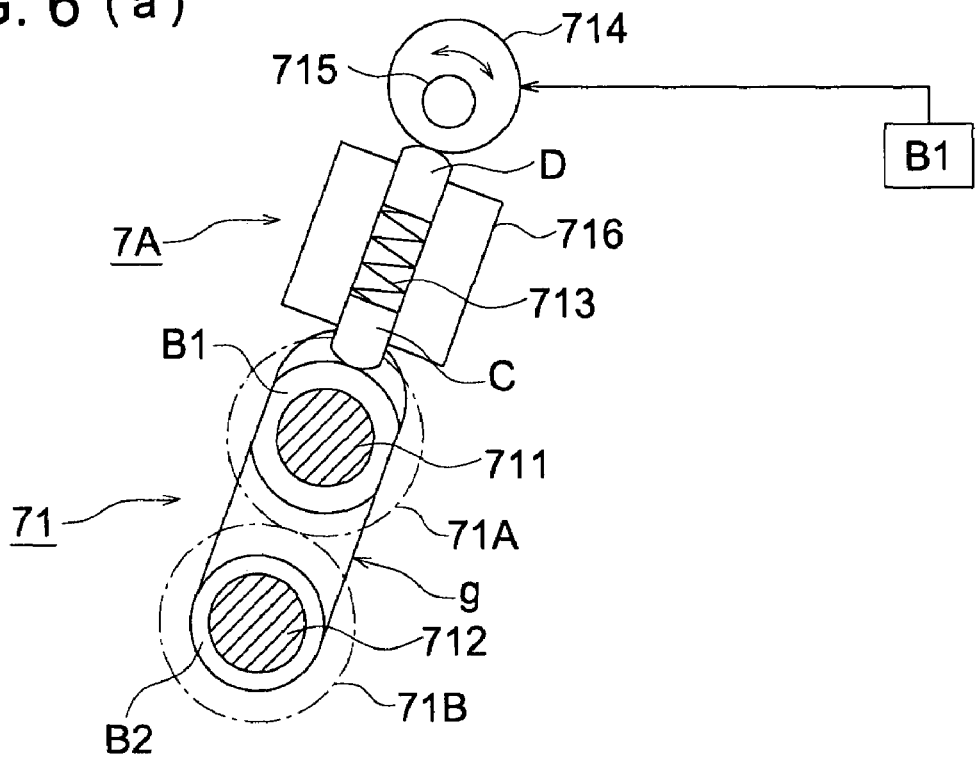
FIGS. 6 (*a*) and (*b*) are cross sectional views of the registration roller as viewed from the side of a pressure mechanism.
Figure 6:
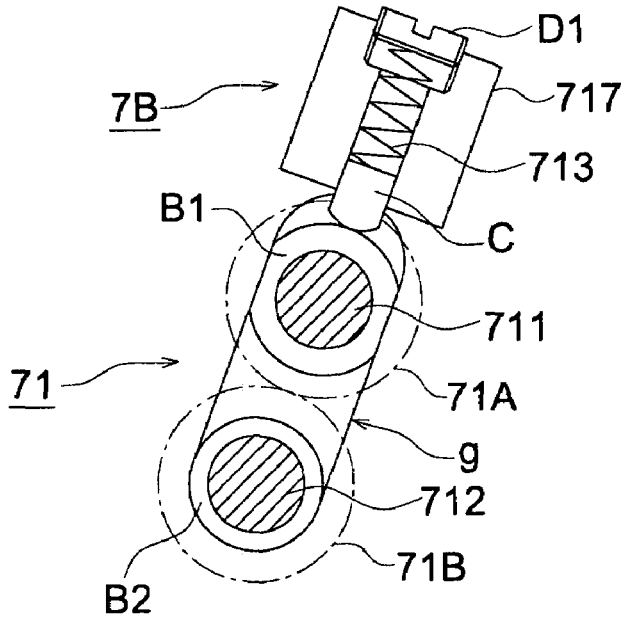

FIG. 6 is a cross sectional view showing the pressure mechanism of a registration roller as viewed from the side.

This pressure mechanism has a function of rotating the transfer medium a predetermined angle in the conveying direction.

In FIG. 5 and FIGS. 6(*a*)-(*b*), the registration roller 71 incorporates a pressure roller 71A (built integrally with rotary shaft 711) and a fixing roller 71B (built integrally with rotary shaft 712), and is supported through the bearings B1 and B2 fitting into the slot "g" of the sheet feed section frames A and B. The bearing B1 is designed in a two-way shear configuration to slide along the slot g. The bearing B2 is stopped by the lower end of the slot g. The pressure mechanisms 7A and 7B fixed on the sheet feed section frames A and B are provided on both ends of the aforementioned rotary shaft 711. A pressure mechanism 7A on one side is made up of a spring 713, spring guide member 716, and spring contact members C and D, and the pressure member 7B on the other side is made of a spring 713, spring guide member 717, and spring pressure adjusting member D1. The spring guide members 716 and 717 are mounted on the aforementioned sheet feed section frames A and B. The pressure mechanism 7A is structure in such a way that the eccentric cam 714 built integrally with the rotating shaft 715 obtains a rotary force from the drive section (not illustrated) in response to the command of the control section B1, and is rotated a predetermined angle θ. It pushes the bearing B1 through the spring 713 and spring contact members C and D, whereby the pressure on one side of the pressure roller 71A and fixing roller 71B can be changed. The pressure mechanism 7B pushes the bearing B1 through a spring retaining screw D1 and a spring 713 and spring holding member C, so that the pressure on the other side of the pressure roller 71A and fixing roller 71B is adjusted to the level of reference pressure.

Assume, for example, the case of feeding a transfer medium that is so stiff that the transfer medium trailing edge gives impact shock to the intermediate transfer belt 20. In response to the command of the control section B1, the eccentric cam 714 rotates a predetermined angle to change the pushing pressure of the pressure mechanism 7A to a level greater (or smaller) than the reference pressure of the pressure mechanism 7B, whereby a predetermined pressure difference is generated. This pressure difference gives a slight skew to the transfer medium conveyed by the registration roller 71. The rotary angle of the aforementioned eccentric cam 714 for generating the pressure difference (corresponding to the angle difference θ between the front edge of the upper transfer guide plate 31 and transfer medium trailing edge) is stored in the Table of the control section B1. Further, the control section B1 provides command to ensure that the writing unit 12 performs scanning operation as it is tilted the corresponding angle θ with respect to the rotary angle θ of the transfer medium on the image carrier. This timing is synchronized with the detection of the sheet type by the sheet type detecting sensor S1. The aforementioned rotation is performed only when the aforementioned sheet type detecting sensor S1 has detected the transfer medium having a predetermined thickness or more.

If the thickness is smaller, difference in angle of the sheet trailing edge in the main scanning direction is assumed as zero (without rotation). To be more specific, the secondary transfer roller 26 (ground roller 22) and the front edge f of the upper transfer guide plate 31 are arranged to be parallel to each other.

Accordingly, in the case of thick sheet, the registration roller 71 conveys the transfer medium while the front edge of the aforementioned upper transfer guide plate 31 and the trailing edge of the aforementioned transfer medium maintain the predetermined angle difference θ. Thus, without the entire trailing edge of the transfer medium hitting the intermediate transfer belt 20 in one operation, they gradually come into contact. This arrangement reduces the impact shock, avoids an image failure at the nip portion S.

It should be noted that, without using the aforementioned sheet type detecting sensor S1, the operator can select the sheet using the sheet type input section of the operation panel 85 (FIG. 1).

Under the aforementioned conditions, a comparison test was conducted on the method of forming a slight bend of the aforementioned transfer medium in the conveying direction by the pressure difference of the aforementioned registration roller so that angle difference θ is given to the upper transfer guide plate and transfer medium trailing edge, and the method of the Comparative Example without angle difference.

Test Condition

Model used: Tandem type color photocopier

Intermediate transfer belt: Thermosetting polyimide coated with conductive material; thickness: 0.10 mm; belt speed: 220 mm/s Secondary transfer roller: Diameter 30 mm, conductive solid rubber, hardness: 67±3 degrees; electrical resistivity: $4\times10^7\Omega$ Ground roller: Diameter 30 mm, conductive solid rubber, hardness 67±3 degrees, electrical resistivity: $4\times10^7\Omega$ Pressure of registration roller: set at 0.25 kgf on one side and 1 kgf on the other side.

Sheet skew: In the Example, difference of distances between the front edge of the upper transfer guide plate and the sheet trailing edge was 1 mm at both ends of long side of A4-sized paper in the main scanning direction in Example. In the in Comparative Example, there was no difference in Comparative Example. (The front edge of the upper transfer guide plate is parallel with the sheet trailing edge in the Comparative Example.)

Paper used: A4, 256 g/m$^2$ (thick paper)

Test Evaluation

The level of scattering of image characters 20 mm from the trailing edge of the sheet at the time of paper feed was evaluated.

Result

There was no scattering of image characters in the Example, but image characters were scattered in the Comparative Example.

The aforementioned test has verified that, for thick paper, the aforementioned transfer medium is conveyed while a predetermined angle difference is maintained between the front edge of the guide member arranged on the side of the image carrier and the trailing edge of the aforementioned transfer medium, whereby the impact shock on image carrier can be reduced and scattering of image characters in the transfer section can be prevented.

The following describes the rotating mechanism of the transfer medium guide member, wherein the aforementioned transfer guide member is rotated so that the front edge of the transfer guide member arranged on the side of the image carrier is tilted in the main scanning direction, and a predetermined angle with the trailing edge of the transfer medium is maintained.

Figure 7:
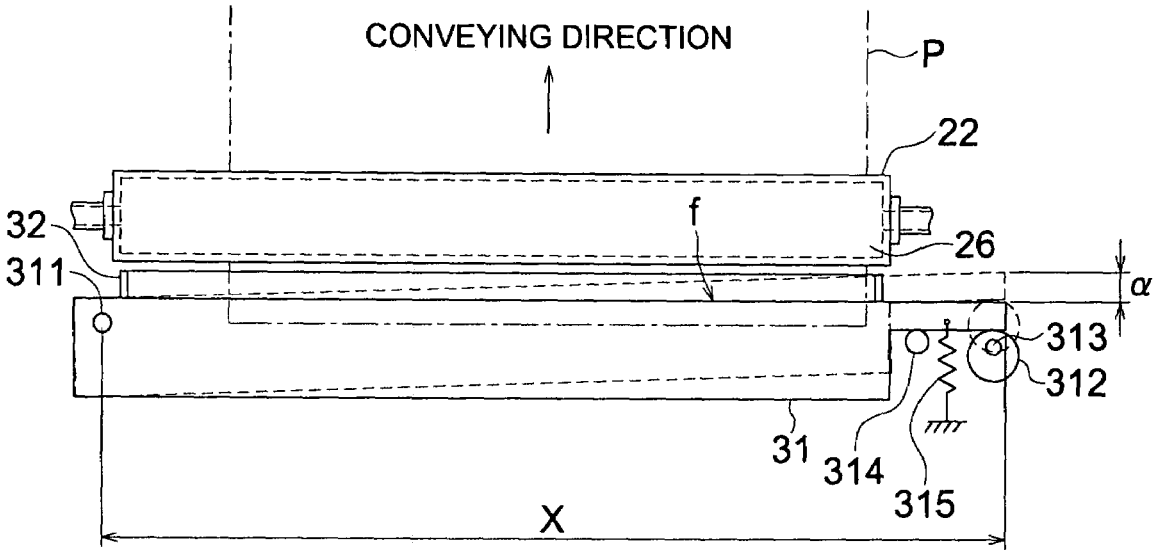
FIG. 7 is a diagram showing the mechanism for rotating the transfer guide member located on the side of the image carrier.

FIG. 7 is a diagram showing the mechanism for rotating the transfer guide member located on the side of the image carrier.

In FIG. 7, the upper transfer guide plate 31 rotates using the fulcrum shaft 311 on one end as a fulcrum (wherein "X" indicates the length from the fulcrum through the other end). The other end is connected with a spring 315, and the aforementioned upper transfer guide plate 31 is pulled in the clockwise direction, with the stopper 314 standing still. At standstill, the front edge f of the upper transfer guide plate 31 is kept parallel to the main scanning direction. Only when the sheet has been detected by the S1 to have a thickness equal to or greater than a predetermined level, the eccentric cam 312 built integrally with the rotating shaft 313 rotates a predetermined angle in response to the command from the control section B1, and the deflection α of the front edge of the upper transfer guide plate 31 is created with respect to the main scanning direction (trailing edge of sheet). The deflection α is changed in response to the sheet type (heavy paper) and sheet width that are likely to raise a problem. The rotary angle of the aforementioned eccentric cam 312 for creating the deflection α is stored in the Table of the control section B1. The aforementioned rotation is used only when the aforementioned sheet type detecting sensor S1 has detected the transfer medium having a thickness equal to or greater than a predetermined thickness (or weight).

When the thickness is smaller (for the sheet type without any problem), there is assumed to be no deflection of the sheet trailing edge in the main scanning direction (no rotation). To be more specific, the secondary transfer roller 26 (ground roller 22) and the front edge f of the upper transfer guide plate 31 are arranged to be parallel to each other.

It is also possible to make such arrangements that the operator uses the sheet type input section of the operation panel 85 (FIG. 1) to select the sheet, without using the aforementioned sheet type detecting sensor S1.

Under the aforementioned conditions, a comparative test was conducted on the method of tilting the upper transfer guide plate by deflection α according to this approach, and the Comparative Example for checking presence or absence of deflection.

Test Condition

Model used: Tandem type color photocopier

Intermediate transfer belt: Thermosetting polyimide coated with conductive material; thickness: 0.10 mm; belt speed: 220 mm/s Secondary transfer roller: Diameter 30 mm, conductive solid rubber, hardness: 67±3 degrees; electrical resistivity: $4\times10^7\Omega$ Ground roller: Diameter 30 mm, conductive solid rubber, hardness 67±3 degrees, electrical resistivity: $4\times10^7\Omega$ Deflection α: α=6 mm for the Example, and α=0 for the Comparative Example (upper transfer guide plate front edge and sheet trailing edge are parallel to each other), X=320 mm Paper used: A4, 256 g/m$^2$ (thick paper)

Test Evaluation

The level of scattering of image characters 20 mm from the trailing edge of the sheet at the time of paper feed was evaluated.

Result

There was no scattering of image characters in Example, but image characters were scattered in the Comparative Example.

The result of the aforementioned test has verified that the aforementioned transfer medium is conveyed while a predetermined angle difference is maintained between the front edge of the guide member arranged on the side of the image carrier and the trailing edge of the aforementioned transfer medium, whereby impact shock on the image carrier is reduced and scattering of image characters in the transfer section can be prevented. Thus, the present invention is applicable to both the thin paper and thick paper without any problem.

As described above, according to the present embodiment, the apparatus is structured such that even in use of high stiffness recording medium, since the trailing edge of the medium does not come out of the transfer guide member at a moment, and comes out from one side in the main scanning direction, the impact, generated by hitting of the trailing edge of the recording medium onto the image carrier, is reduced, thereby, problems such as toner scattering and image misalignment can be prevented.

What is claimed is:

1. An image forming apparatus comprising:

an image forming section to form a toner image on an image carrier;

a transfer section to transfer onto a transfer medium the toner image formed on the image carrier; and a pair of opposing transfer guide members to guide the transfer medium into the transfer section, wherein a front edge of one transfer guide member, arranged on a side of the image carrier out of the pair of the transfer guide members, is disposed separately from the other transfer guide member, and one side portion of the front edge of the transfer guide member is more protruded than the other side portion into a conveying direction of the transfer medium.

2. The image forming apparatus of claim 1, wherein the transfer guide member arranged on the side of the image carrier member has a configuration such that an amount of protrusion of the front edge is gradually reduced from one end to the other in a main scanning direction which is approximately parallel to the conveying direction of the transfer medium.

3. The image forming apparatus of claim 1, a conveying path of the transfer medium is vent in the vicinity of the transfer section with respect to a transfer medium conveying direction.

4. The image forming apparatus of claim 1, wherein the transfer section comprises a transfer roller.

5. The image forming apparatus of claim 1, wherein the image carrier is shaped in a belt.

6. An image forming apparatus comprising:

an image forming section to form a toner image on an image carrier;

a transfer section to transfer onto a transfer medium the toner image formed on the image carrier; and a pair of opposing transfer guide members to guide the transfer medium into the transfer section, wherein an angle difference between the front edge of the transfer guide member arranged on the side of the image carrier out of a pair of the transfer guide members, and the trailing edge of the transfer medium having been fed through the front edge is changed in response to a type of the transfer medium, where the angle difference is a difference between a first angle formed by a main scanning direction and the front edge of the guide member, and a second angle formed by the main scanning direction and the trailing edge of the transfer medium.

7. The image forming apparatus of claim 6, wherein the transfer medium is conveyed with the angle difference predetermined only in cases where the transfer medium has a thickness of predetermined value or greater.

8. The image forming apparatus of claim 6, wherein the transfer medium is conveyed with the angle difference of zero in cases where the transfer medium has a thickness of predetermined value or less.

9. The image forming apparatus of claim 8, further comprising a pair of registration rollers which nip to convey the transfer medium, wherein the angle difference is generated such that pressing forces at one side in the main scanning direction and at the other side of the pair of registration rollers are controlled to generate a skew in the conveyance of the transfer medium.

10. The image forming apparatus of claim 6, further comprising a rotation mechanism which rotates the transfer medium so that the transfer medium is conveyed with a condition that the trailing edge is tilted with respect to the main scanning direction.

11. The image forming apparatus of claim 10, wherein an image is formed on the image carrier to be tilted with respect to the main scanning direction corresponding to an operation of the rotation mechanism.

12. The image forming apparatus of claim 6, further comprising a rotation mechanism which rotates the transfer guide member arranged on the side of the image carrier so that the front edge of the transfer guide member is tilted with respect to the main scanning direction.

13. The image forming apparatus of claim 6, further comprising a sheet type input section through which an operator inputs a setting of a sheet type of the transfer medium.

14. The image forming apparatus of claim 6, further comprising a sheet type detecting sensor which detects the sheet type of the transfer medium, and the sensor being arranged on a paper cassette or a sheet conveyance path.

15. The image forming apparatus of claim 6, a conveying path of the transfer medium is vent in the vicinity of the transfer section with respect to a transfer medium conveying direction.

16. The image forming apparatus of claim 6, wherein the transfer section comprises a transfer roller.

17. The image forming apparatus of claim 6, wherein the image carrier is shaped in a belt.

* * * * *